US005886288A

United States Patent [19]

Brunn

[11] Patent Number: 5,886,288

[45] Date of Patent: Mar. 23, 1999

[54] HAND GRENADE SAFETY PIN

[76] Inventor: Michael Brunn, 308 Littleworth La., Seacliff, N.Y. 11579

[21] Appl. No.: 979,717

[22] Filed: Nov. 28, 1997

[51] Int. Cl.[6] ..... F42B 8/26

[52] U.S. Cl. ..... 102/482; 102/486

[58] Field of Search ..... 102/482–488, 102/258, 260, 261, 259; 89/1.55

[56] References Cited

U.S. PATENT DOCUMENTS

| | | | |
|---|---|---|---|
| 1,560,628 | 11/1925 | Wiley | 102/487 |
| 2,941,471 | 6/1960 | Sunden | 102/482 |
| 3,765,337 | 10/1973 | Padula | 102/487 |
| 3,865,027 | 2/1975 | Dubno et al. | 102/487 |

FOREIGN PATENT DOCUMENTS

| | | | |
|---|---|---|---|
| 2053948 | 4/1971 | France | 102/482 |
| 79383 | 12/1919 | Germany | 102/482 |
| 2262330 | 6/1993 | United Kingdom | 102/486 |
| WO 81/00451 | 2/1981 | WIPO | 102/487 |

*Primary Examiner*—Harold J. Tudor
*Attorney, Agent, or Firm*—Myron Amer P.C.

[57] ABSTRACT

A hand grenade safety pin with attached pull ring which is installed with a rotative degree of movement and in one directional rotative traverse the pull ring clears a blocking arm so that the grenade can be detonated and, if circumstances warrant, an opposite rotative traverse restores the safety function of the safety pin.

1 Claim, 2 Drawing Sheets

HAND GRENADE SAFETY PIN

The present invention relates generally to improvements in a hand grenade safety pin which, as known, until withdrawn prevents inadvertent detonation of the hand grenade, the improvements more particularly obviating inadvertent withdrawal of the safety pin.

EXAMPLE OF THE PRIOR ART

The utility of a safety pin as a first safety measure to prevent inadvertent detonation is well known, and it is even a well known second safety measure to prevent inadvertent withdrawal of the safety pin. Thus, as exemplified by U.S. Pat. No. 3,865,027 for Hand Grenade with Safety Mechanism issued to Richard C. Dubno et al. on Feb. 11, 1975, the second safety measure described in this patent uses a shaped notch in the withdrawal path of the safety pin that a corresponding shape on the safety pin must align with in order for the safety pin to be fully withdrawn incident to detonation of the hand grenade. While a useful safety measure, once the safety pin of the '027 patent clears the referred-to shaped notch, the user is either committed to detonating the grenade or, if there is a change in plans, returning the safety function of the safety pin by clearing the shaped notch in a reverse directional movement of the safety pin. Placement of the safety pin properly back into its inserted operative position within the grenade is not assured, and the reverse aligning procedure of the noted shapes requires dexterity.

Broadly, it is an object of the present invention to provide improvements in the use of a hand grenade safety pin overcoming the foregoing and other shortcomings of the prior art.

More particularly, it is an object to prevent inadvertent withdrawal of the safety pin without partial withdrawal thereof or manipulation of the safety pin in a manner that cannot be readily reversed incident to restoring the full safety function of the safety pin, all as will be better understood as the description proceeds.

The description of the invention which follows, together with the accompanying drawings should not be construed as limiting the invention to the example shown and described, because those skilled in the art to which this invention appertains will be able to devise other forms thereof within the ambit of the appended claims.

Figure 6:
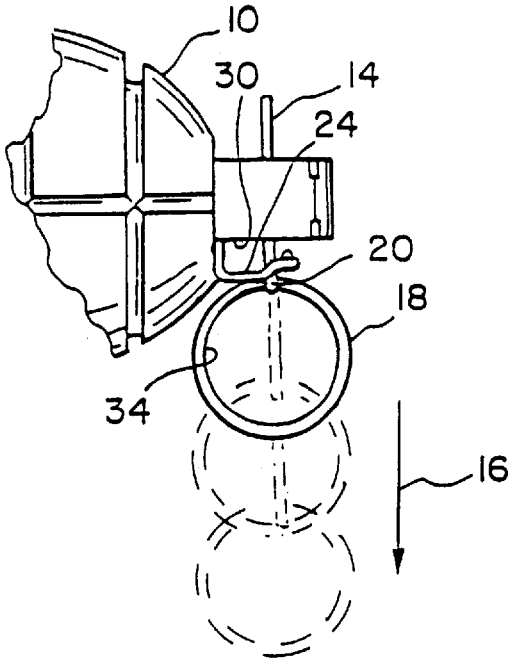
FIG. 6 is a partial perspective view similar to FIG. 3.

Illustrated is a known hand grenade 10 of a type well documented in prior patents, as exemplified by U.S. Pat. No. 2,941,471 and the patents cited therein, with a known operating mode in which a lever 12 releases an internal firing train, including an explosive charge and detonator, which results in corresponding detonation of the hand grenade 10. Inadvertent operation of lever 12 is prevented, also as is well known, by a cotter pin in mechanical parlance but better known as a safety pin 14 which, as best shown in FIG. 6, requires withdrawal, as noted by the arrow 16, before the lever 12 has its intended operative effect. The within inventive advance is the embodiment of the safety pin 14 so that it is not inadvertently withdrawn and thus detached from the grenade 10 except by an intended gripping of a pull ring 18 attached, as at 20, to the safety pin 14 and pulled in the direction 16.

To the above end, the safety pin 14 is appropriately mounted in the grenade 10 so as to have a rotative degree of movement, as will be subsequently explained in connection with FIG. 3 wherein said rotative movement path is designated 22. Cooperating with the safety pin 14 is a pull ring-engaging arm 24 of a prescribed linear extent 26 connected at one end, as at 28, to the grenade 10 and extending in a clearance 30 above the grenade so as to position a free end 32 of the arm 24 in a projected relation through a circular opening 34 bounded by the pull ring 18 previously noted to be attached to an exposed upper end of the safety pin 14. Thus, best shown in FIG. 1, the projected condition of the arm 24 encumbers removal of the safety pin/pull ring 14, 18 from the grenade 10.

Figure 1:
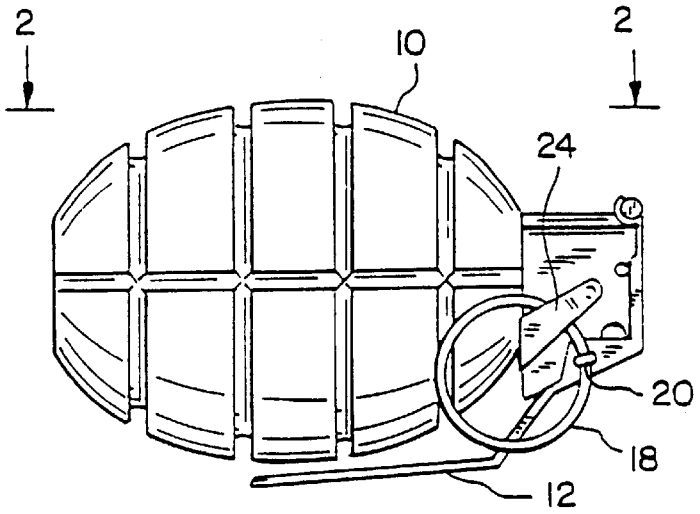
FIG. 1 is a front perspective view of a hand grenade with an improved safety pin.
Figure 2:
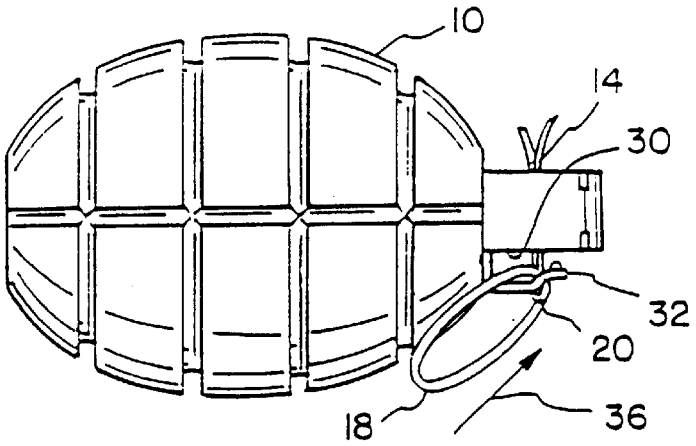
FIG. 2 is a plan perspective view of the hand grenade as seen in the direction of line 2—2 of FIG. 1.
Figure 3:
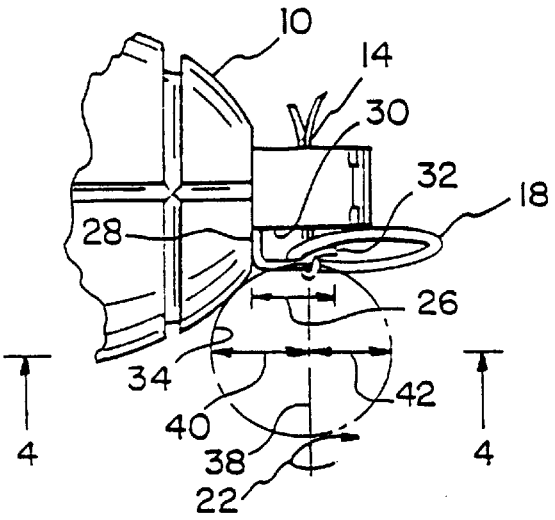
FIG. 3 is a partial perspective view similar to FIG. 2 showing further structural details.

From the encumbered condition of FIGS. 1 and 2, pull ring 18 is intended to be urged in a pivotal traverse 36 optionally into an initial position of movement illustrated in phantom in FIG. 3 or to a final position of movement illustrated in full line. In connection with the phantom position of movement it will be noted that the pull ring-engaging arm 24 intersects the pull ring opening 34 at an intersecting location 38 selected to delineate an inboard extent 40 which exceeds an outboard extent 42 which assures that a rotational traverse 22 of the pull ring 18 will result in the pull ring clearing the arm free end 32. Cleared of the arm 24, the pull ring 18 is readily pulled by the user in the withdrawing direction 16 from the grenade 10 if the user so desires. It is also important to note that, if the user decides not to leave the pull ring 18 in the FIG. 6 ready condition in which it is unencumbered by the arm 24, a reverse direction rotational traverse will restore the encumbered condition to the pull ring 18 and correspondingly restore a full safety function as provided by the safety pin 14 to the grenade 10.

Figure 4:
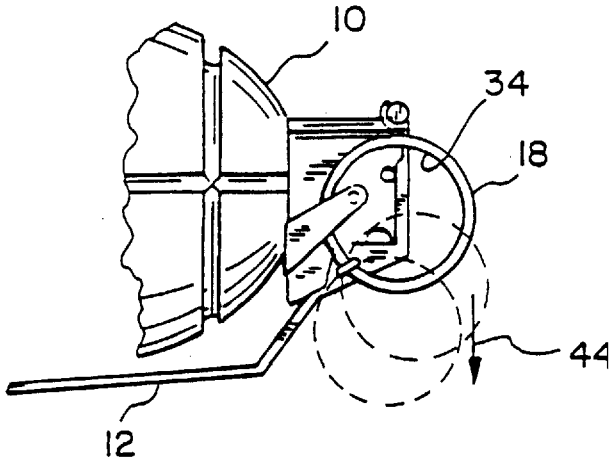
FIG. 4 is a perspective view as seen in the direction of line 4—4 of FIG. 3.
Figure 5:
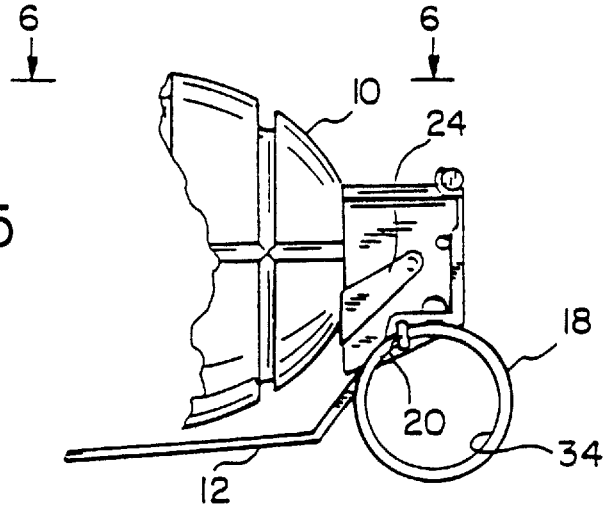
FIG. 5 is a partial perspective view similar to FIG. 4 showing further structural details.

Referring again to FIG. 3, from the full line position of movement of the pull ring 18, the pull ring 18 has a pivotal traverse 44 degree of movement from beneath the arm 24 into progressive positions of movement illustrated in FIGS. 4 and 5, in which FIG. 5 position the pull ring 18 being clear of the arm 24 is optionally withdrawn from the grenade 10 to allow detonation thereof.

While the apparatus herein shown and disclosed in detail is fully capable of attaining the objects and providing the advantages hereinbefore stated, it is to be understood that it is merely illustrative of the presently preferred embodiment of the invention and that no limitations are intended to the detail of construction or design herein shown other than as defined in the appended claims.

What is claimed is:

1. A hand grenade comprising a body, a selected site in said body for a safety pin, an elongated safety pin having a longitudinal axis disposed at said site so as to partake of rotative movement about said longitudinal axis in a clockwise direction, an arm having opposite first and second ends attached to said body so as to bound a clearance area between said arm and said body, said first arm end being attached to said body in a counterclockwise clearance position from said site for said safety pin, said second arm end being unattached to said body so as to bound an opening in communication with said clearance area, and a circular pull ring connected to said safety pin and having an inoperative position disposed in said clearance area beneath said second end of said arm, said pull ring and said safety pin being urged in clockwise movement so that said pull ring is removed from said clearance area to a position of movement beyond said second arm end, whereby only subsequent to said clockwise rotation of said pull ring and said safety pin, and the removal of said safety pin from said hand grenade can there be detonation of said hand grenade.

* * * * *